United States Patent [19]

Araki et al.

[11] 3,978,552

[45] Sept. 7, 1976

[54] METHOD AND DEVICE FOR SUPPLYING A FRESH COTTON BALE IN A BALE PLUCKING MACHINE

[75] Inventors: Hidejiro Araki, Toyoake; Susumu Ōtani, Obu, both of Japan

[73] Assignee: Kabushiki Kaisha Toyoda Jidoshokki Seisakusho, Japan

[22] Filed: Sept. 4, 1974

[21] Appl. No.: 502,924

[30] Foreign Application Priority Data

Sept. 10, 1973 Japan ..... 48-101949

[52] U.S. Cl. ..... 19/80 R

[51] Int. Cl.[2] ..... D01G 7/04

[58] Field of Search ..... 19/80 R, 81, 145.5; 241/101 A

[56] References Cited

UNITED STATES PATENTS 3,381,341 5/1968 Platt et al. ..... 19/80 R

FOREIGN PATENTS OR APPLICATIONS 838,793 6/1960 United Kingdom ..... 19/80 R 841,216 7/1960 United Kingdom ..... 19/80 R

*Primary Examiner*—Dorsey Newton

[57] ABSTRACT

In a bale plucking machine wherein a fiber bale is reciprocally displaced between a pair of displacement terminals by a pair of conveyer means disposed with an intervening space therebetween and fiber tufts are continuously plucked from the fiber bale by a plucking roller when the fiber bale passes over the plucking roller, a method and device for supplying a fresh fiber bale on the conveyer means. When the thickness of the processing fiber bale has been reduced to a predetermined limit, the processing fiber bale is displaced to a waiting position formed on an extended portion of one of the conveyer means outside the terminal of the reciprocal displacement thereof, and the conveyer means are stopped. Thereafter a fresh fiber bale is supplied onto the processing fiber bale reserved at the waiting position. During the above-mentioned supply motion, the driving of the conveyer means is again commenced.

8 Claims, 8 Drawing Figures

METHOD AND DEVICE FOR SUPPLYING A FRESH COTTON BALE IN A BALE PLUCKING MACHINE

SUMMARY OF THE INVENTION

The present invention relates to a method and device for supplying a fresh cotton bale to a bale plucking machine wherein fiber tufts are plucked from the botton of a pressed fiber bale.

In the coventional bale plucking operation, fiber tufts are continuously plucked from a pressed cotton bale by a plucking roller when the pressed cotton bale is reciprocally displaced over the plucking roller by means of a pair of conveyer belts. The mass of the cotton bale is gradually reduced by the above-mentioned plucking operation and, finally, exhausted. Thereafter, a fresh cotton bale is supplied to one of the above-mentioned conveyer belt so as to continue the bale plucking operation.

In the above-mentioned bale plucking operation, the rate of plucking the fiber tufts from the pressed fiber bale and the size of the plucked fiber tufts are influenced by the pressing force which urges the fiber bale toward the plucking roller, after the mass of the fiber bale is reduced to a certain limit by the plucking operation. Since the above-mentioned pressing force depends upon the weight of the cotton bale displacing over the plucking roller and, further, the weight of the fiber bale decreases during the plucking operation, the plucking rate and size of the plucked fiber tufts vary with the passage of time in the plucking operation. Therefore, such variations of plucking rate, and of size of plucked fiber tufts, have an undesirable influence upon the successive process steps such as irregular opening and cleaning of fiber tufts. For example, in the case of utilizing a plurality of bale plucking machines for carrying out an opening and mixing operation of fiber tufts plucked from different cotton bales, the mixing ratio of the fiber tufts is changed according to the variation of the plucking rate and size of the plucked fiber tufts.

To solve the above-mentioned problem, a method (or device) for compensating for the above-mentioned decrease of the weight of the cotton bale during the plucking operation has been utilized. However, such compensation device makes the structure of the plucking machine more complex so that the installation cost of the plucking machine is increased.

Further, in the conventional plucking machine, the supply of a fresh fiber bale to the bale plucker is carried out manually. Therefore, the plucking operation is stopped at the time of supplying a fresh fiber bale. Thus, the working efficiency of the plucking machine is reduced.

The principal object of the present invention is to solve the above-mentioned problems of conventional bale plucking machines, by providing a unique method and device for supplying a fresh fiber bale to a bale plucking machine.

According to the present invention, when the mass of the pressed fiber bale on the conveyer means is reduced to a predetermined limit, the reciprocal carrying motion of the conveyer means is temporarily stopped so as to position the fiber bale being processed at a predetermined position on one of the conveyer means. Next a fresh fiber bale is fed to the above-mentioned conveyer means in such a condition that the fresh fiber bale is superimposed upon the fiber bale being processed. Then, the reciprocal displacing motion of the conveyer means is restarted so as to displace the superimposed fiber bales to a working position of the plucking roller. The above-mentioned motion is repeated each time the mass of fiber bale on the conveyer means is reduced to a predetermined limit.

To carry out the above-mentioned operation for supplying a fresh fiber bale to the conveyer means, an additional conveyer means is disposed at a position above and adjacent to a part of one of the conveyer means, and a detector for detecting the condition of mass of the fiber bale, which is being processed, is disposed at a position adjacent to a displacing passage of the fiber bale on the conveyer means. When the above-mentioned detector detects that the mass of the fiber bale being processed has reached a predetermined condition, the detector issues a signal to stop the motion of the conveyer means and then the additional conveyer means is driven so as to supply a fresh fiber bale onto one of the conveyer means in such a condition that the fresh fiber bale is positioned upon the fiber bale being processed in superimposed condition.

Consequently, with the present invention the motion of supplying a fresh fiber bale to the conveyer means can be carried out automatically without any troublesome manual operations. Further, if a plurality of plucking machines are utilized to carry out the mixing operation of several different raw materials, the mixing ratio can be maintained uiform during the plucking operation since the plucking rate of the fiber bale in each plucking machine can be maintained uiform during the plucking operation.

DETAILED EXPLANATION OF THE PRESENT INVENTION

Figure 1:
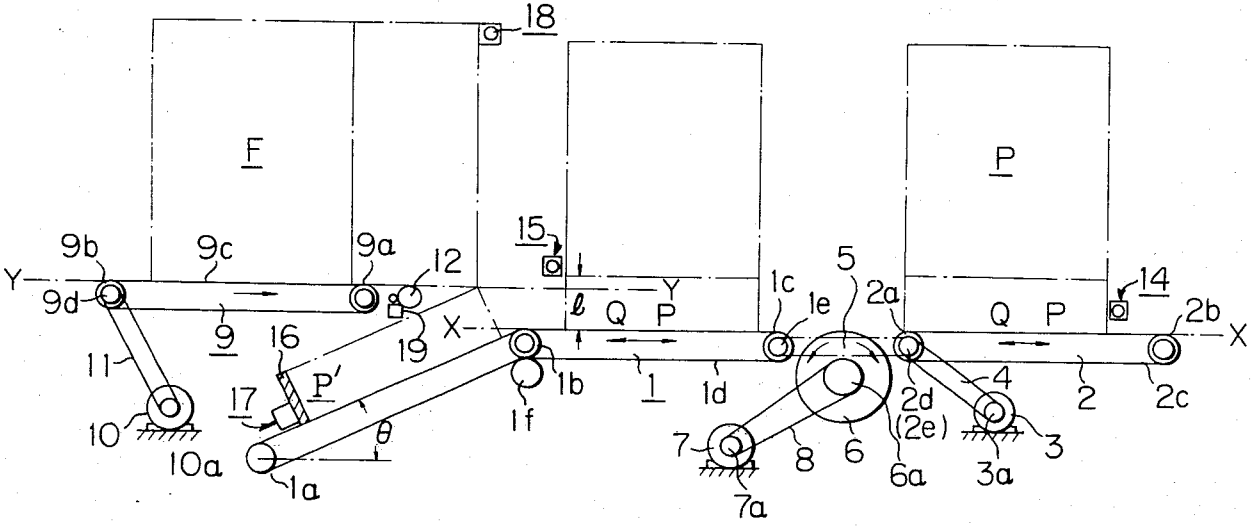
FIG. 1 is a schematic side view of a bale plucking machine provided with the apparatus according to the present invention.
Figure 2:
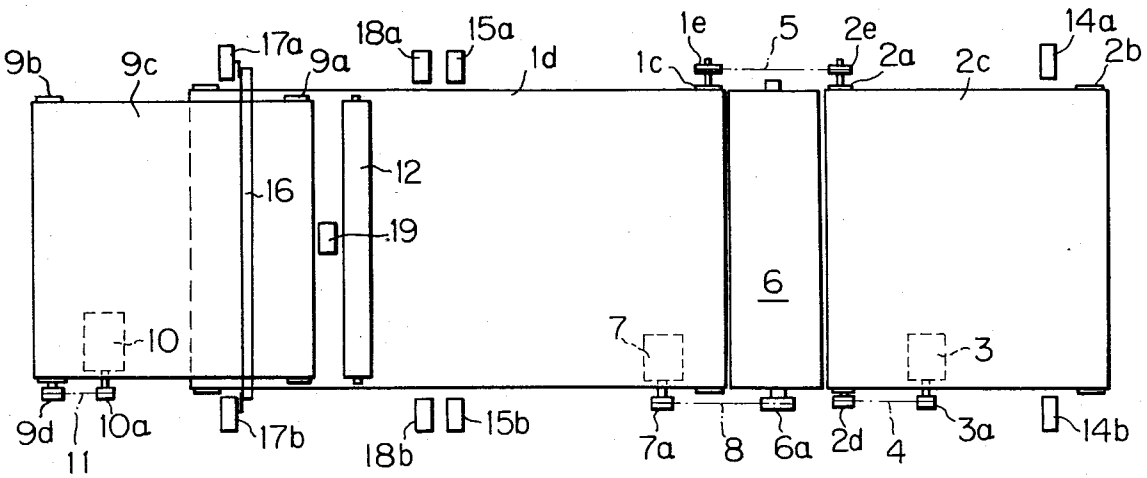
FIG. 2 is a schematic plan view of the bale plucking machine shown in FIG. 1.

In the bale plucking machine shown in FIGS. 1 and 2, a pair of conveyer means 1 and 2 are disposed in alignment with an intervening space therebetween, and a plucking roller 6 is disposed in the above-mentioned intervening space in such a condition that the circular profile of the plucking roller is projected into the supporting level of the fiber bale which is identical to a horizontal plane passing through the top surfaces of the conveyer means 1 and 2. The conveyer blet means 1 comprises guide rollers 1*a*, 1*b* and 1*c* and an endless apron 1*d* supported by these rollers 1*a*, 1*b* and 1*c*. The guide roller 1*c* works as a drive roller. A roller 1*f* is disposed at a position below the guide roller 1*b* in such a condition that the roller 1*f* rotatably contacts the endless apron 1*d*. The guide roller 1*a* is positioned at a lower level than the disposition of the guide rollers 1*b* and 1*c* so that the endless apron 1*d* is partly inclined as shown in FIG. 1. The conveyer means 2 comprises guide rollers 2*a* and 2*b* and an endless apron 2*c* supported by these rollers 2*a* and 2*b*. The guide roller 2*a* works as a drive roller. An additional horizontal conveyer means 9 is disposed above the inclined portion of the endless apron 1*d* in such a way that the distance between the forward end of the conveyer means 9 and the inclined portion of the endless apron 1*d* is larger than $l$ (FIG. 1), where $l$ represents the predetermined thickness of a cotton bale on top of which a fresh cotton bale should be supplied. Further, it is required to position the conveyer means 9 in such a condition that the upper surface of the conveyer means 9 substantially coincides with a horizontal plane Y—Y which is positioned above a horizontal plane X—X defined by the upper horizontal surfaces of the endless apron 1*d* and 2*c* at a distance $l(\cos\theta)^2$ where $\theta$ represents the inclined angle of the left-hand portion of endless belt 1*d* as viewed in FIG. 1. The additional conveyer belt means 9 comprises a pair of guide rollers 9*a* and 9*b*, and an endless apron 9*c* supported by the guide rollers 9*a* and 9*b* as shown in FIG. 1. The guide roller 9*b* is a drive roller. An additional roller 12 is rotatably disposed in a space between the endless apron 9*c* and the inclined portion of the endless apron 1*d* in such a condition that the roller 12 is positioned at the same level as the endless apron 9*c*.

A reversible motor 3 is disposed below the conveyer means 2 and a roller 2*a* is driven by the motor 3 by way of a power transmission mechanism comprising a plulley 3*a* rigidly mounted on a shaft of the motor 3 and a pulley 2*d* rigidly mounted on an end portion of a shaft of the roller 2*a* and an endless belt 4 mounted on the pulleys 2*d* and 3*a*. A motor 7 is disposed below the plucking roller 6 and the roller 6 is driven by the motor 7 by way of a power transmission mechanism comprising a pulley 7*a* secured to a shaft of the motor 7 and a pulley 6*a* secured to a shaft of the plucking roller 6 and an endless belt 8 mounted on the pulleys 6*a* and 7*a*. Another pulley 2*e* is secured on another end of the shaft of the roller 2*a*, while a pulley 1*e* is secured to a shaft of the roller 1*c* in a condition facing the pulley 2*e*. The driving power of the pulley 2*e* is transmitted to the pulley 1*e* by an endless belt 5. Consequently, the endless aprons 1*d* and 2*c* are synchronously driven and stopped. A motor 10 is disposed at a position below the additional conveyer means 9, and the roller 9*b* is driven by the motor 10 by way of a power transmission mechanism comprising a pulley 10*a* secured on a shaft of the motor 10 and a pulley 9*d* secured on a shaft of the roller 9*b* and an endless belt 11 mounted on the pulleys 10*a* and 9*d*.

A pair of detectors 14 and 15 (shown diagrammatically in FIGS. 1 and 2) are mounted above the conveyer means 1 and 2, respectively, as shown in FIGS. 1 and 2. That is, the detector 14 is mounted at a position to and above an end portion of the endless apron 2*c*. The detector 14 comprises a light projector 14*a* and a photocell 14*b* which is capable of receiving light issued from the light projector 14*a*. These elements 14*a* and 14*b* of the detector 14 are shown diagrammatically in FIG. 2 and are respectively disposed at facing positions outside the endless apron 2*c* as shown in FIG. 2. The detector 15 has a structure similar to the detector 14.

That is, the detector 15 comprises a light projector 15*a* and a photocell 15*b* which is capable of receiving light issued from the light projector 15*a*. The light projector 15*a* and the photocell 15*b* are shown diagrammatically and are disposed in facing condition at particular positions adjacently above the roller 1*b* in such a way that the distance between a light beam issued from the light projector 15*a* and the horizontal plane X—X is the above-mentioned predetermined value $l$. The positions of the light beam issued from the light projector 14*a* and the light beam issued from the light projector 15*a* are selected so as to coincide with terminals of the reciprocal motion of a fiber bale which is caused by the motion of the conveyer means 1 and 2. A stopper 16 is adjustably mounted on the inclined portion of the endless apron 1*d* at a position adjacent to the roller 1*a* so as to temporarily position a fiber bale being processed on the inclined portion of the endless apron 1*d* when a fresh fiber bale is supplied thereon, and a limit switch is mounted to a bracket of the stopper 16 in such a condition that when the fiber bale being processed contacts the stopper 16, the limit switches 17 (FIGS. 1 and 2) are actuated. A detailed explanation of the stopper 16 and the limit switches 17 (which are shown diagrammatically in FIGS. 1 and 2) will be presented later.

Another detector 18 is disposed at a position above the inclined portion of the endless apron 1*d* as shown in FIG. 1. The detector 18 comprises a light, projector 18*a* and a photocell 18*b* which is capable of receiving a light beam issued from the light projector 18*a*. These elements 18*a* and 18*b* of the light projector 18 are positioned in facing condition at particular positions above the inclined portion of the endless apron 1*d* which is adjacent to the roller 1*b* where a fresh fiber bale is first placed in contact with a fiber bale being processed, which is temporarily supported by the inclined portion of the endless apron 1*d*. Another limit switch 19 is disposed at a position adjacent to the roller 12. This limit switch 19 issues a signal when a tail end of the fresh cotton bale passes thereover, so as to stop the running of the motor 10. The detailed structure and function of the limit switch 19 will be explained later.

Figure 3:
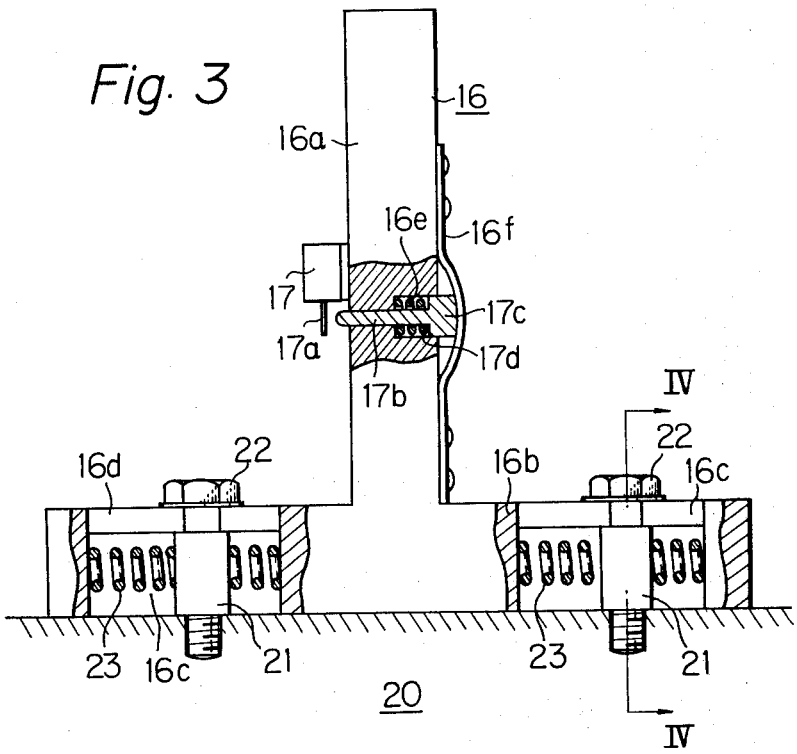
FIG. 3 is a side view, partly in section, of a stopper utilized for the bale plucking machine shown in FIG. 1.
Figure 4:
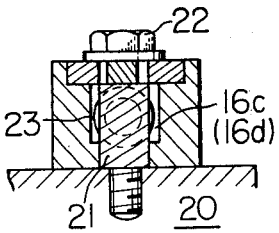
FIG. 4 is a sectional view of a part of the stopper taken along the line IV—IV, in FIG. 3.
Figure 5:
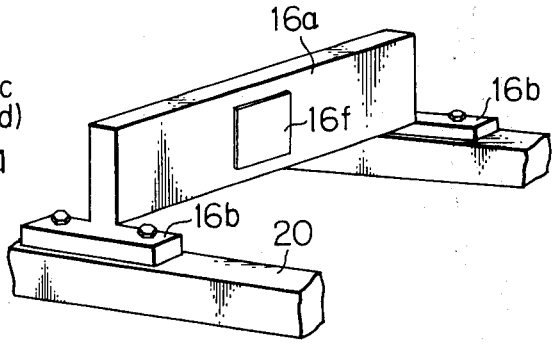
FIG. 5 is a schematic perspective view of the stopper shown in FIG. 3.

Referring to FIGS. 3, 4 and 5, the stopper 16 comprises an upright wall portion 16*a* and a pair of legs 16*b* slidably mounted on side frames 20 of the conveyer means 1. Each leg 16*b* is provided with a pair of slots 16*c* and 16*d* wherein a guide stud 21, which is secured to the side frame 20, passes respectively. A fastener 22 is secured to a top end portion of each stud 21 so as to hold leg 16*b* in a condition that each leg 16*b* is capable of sliding along the side frame 20. A pair of helical springs 23 are disposed in each slot 16*c* (or 16*d*) in a condition that the stud 21 is sandwiched by the springs 23. These springs 23 work as shock absorbers when a fiber bale being processed contacts the wall portion 16*a*. An axxiliary feeler 17*b* is slidably inserted in an aperture formed in the wall portion 16*a* and the auxiliary feeler 17*b* is provided with an expanded head 17*c* which is capable of projecting from a space 16*e* of the wall portion 16*a* toward an outside direction. To prevent escape of the auxiliary feeler 17*b* from the aperture of the wall portion 16*a*, a flexible sheet 16*f* is mounted on the wall portion 16*a* as shown in FIG. 3. An expansion spring 17*d* is inserted in the space 16*e* so as to always urge the head portion 17*c* toward the flexible sheet 16*f*. The limit switch 17 is secured to the wall portion 16*a* at the position where the free end of the auxiliary feeler 17*b* is capable of actuating a feeler 17*a* of the limit switch 17 when a processing fiber bale pushes the flexible sheet 16*f*. As mentioned above, the stopper 16 is capable of fixing the working position thereof by changing the securing position of the studs 21 on the side frames 20. And when the feeler 17*b* is pushed by the processing fiber bale, the limit switch 17 is actuated.

Figure 6:
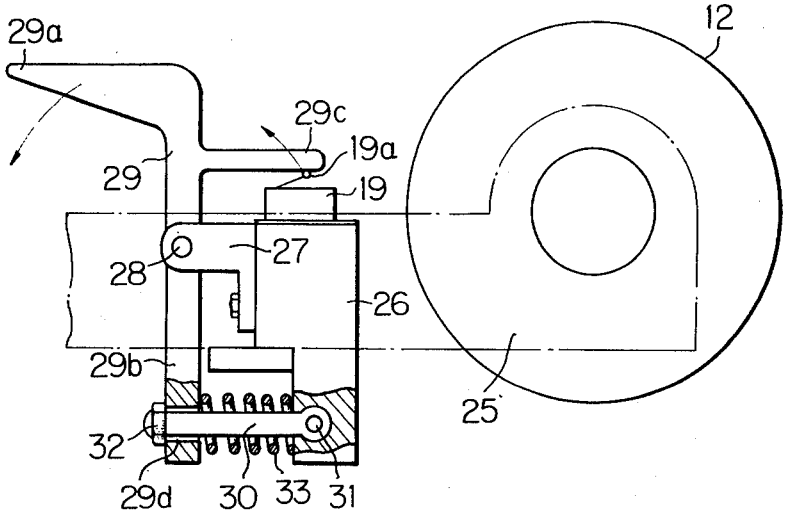
FIG. 6 is a side view, partly in section of a limit switch utilized for the bale plucking machine shown in FIG. 1.

The structure and function of the limit switch 19 is hereinafter explained. Referring to FIG. 6, a transversal bracket 26 is secured to a pair of side frames 25 of the conveyer means 9. At the end of the side frames 25, the roller 12 is rotatably mounted. The limit switch 19 is secured to the transversal bracket 26 at its central portion. A small bracket 27 is secured to the transversal bracket 26 at a position corresponding to the disposition of the limit switch 19. An auxiliary feeler 29 is turnably supported by the small bracket 27 by way of a pin 28. The auxiliary feeler 29 is provided with a horizontally projected portion 29*a* formed at the top end thereof and a small horizontally projected portion 29*c*, which is extended to a position adjacently above the limit switch 19 in such a condition that the portion 29*c* always contacts a feeler 19*a* of the limit switch 19 during the normal plucking operation. The auxiliary feeler 29 is also provided with a lowered extended portion 29*b*. The portion 29*b* is provided with an aperture 29*d*. A stud 30 is turnably mounted on the bracket 26 by a pin 31 as shown in FIG. 6 and the top end portion of the stud 30 is inserted in the aperture 29*d* and a fastening member 32 is secured to the top end of the stud 30. An expansion spring 33 is mounted on the stud 30 at position between the extended portion 29*b* and the bracket 26 so that the auxiliary feeler 29 is always urged to turn clockwise about the pin 28. However, the position of the feeler 29 is fixed by the fastening member 32. In the above-mentioned condition, the small projected portion 29*c* pushes the feeler 19*a* of the limit switch 19 which opens its electric circuit in this condition and closes its electric circuit when the projected portion 29*c* is removed from the feeler 19*a*. The auxiliary feeler 29 is turned counterclockwise when a fresh cotton bale is supplied to the conveyer belt means 1 and front and tail ends of the fresh cotton bale contact the horizontal projection 29*a*.

Figure 7:
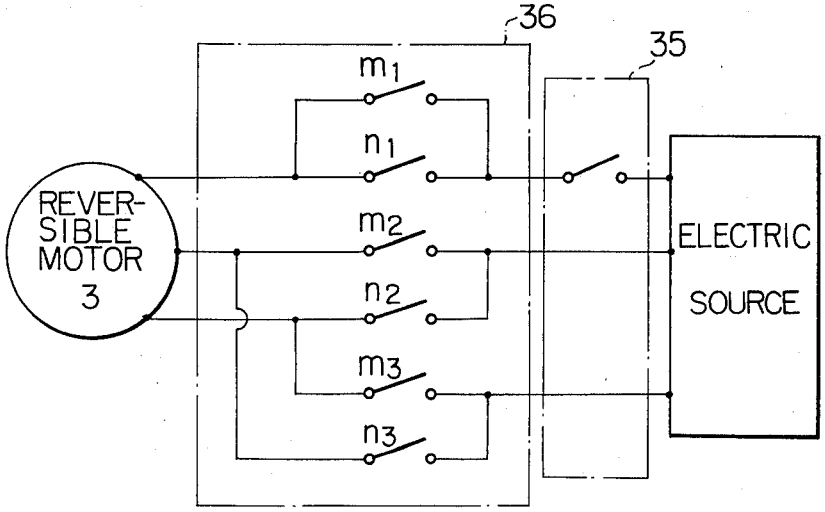
FIG. 7 is a diagram of an electric circuit of the magnetic relays applied to the bale plucking machine shown in FIG. 1.

Means for controlling the motions of the conveyer belt means 1, 2 and 9 is hereinafter explained with reference to FIGS. 7 and 8. The reversible motor 3 is connected to an electric source by way of an on-off relay 35 and a conventional reversible magnetic relay 36 which are arranged in a series. The photocells 14*b* and 15*b* are connected to the magnetic relay 36 in such a way that the photocell 14*b* actuates a solenoid (not shown) so as to close contacts *m*1, *m*2 and *m*3 (FIG. 7) while the photocell 15*b* actuates a solenoid (not shown) so as to close contacts *n*1, *n*2 and *n*3. Consequently, the polarity of input power into the motor 3 is changed alternately by the signals issued from the photocells 14*b*, 15*b* of the respective detectors 14 and 15. These detectors 14 and 15 are provided with means for issuing signals when light beams projected from the respective light projectors 14*a*, 15*a*, are shut out by the fiber bale being processed P′ so that the photocells 14*b*, 15*b* do not receive the light from the light projectors 14*a*, 15*a*, respectively. The limit switch 17 is connected to the on-off relay 35 so as to open the relay 35 when the limit switch 17 is actuated. Therefore, a fiber bale is capable of reciprocally displacing along the horizontal plane X—X between the light beams issued from the light projectors 14*a* and 15*a* of the respective detectors 14 and 15.

The control circuit utilized for the bale plucker is hereinafter explained in detail. For the sake of easy understanding of the function of the device according to the present invention, the operation of the device of the present invention is also explained in the following paragraph.

Figure 8:
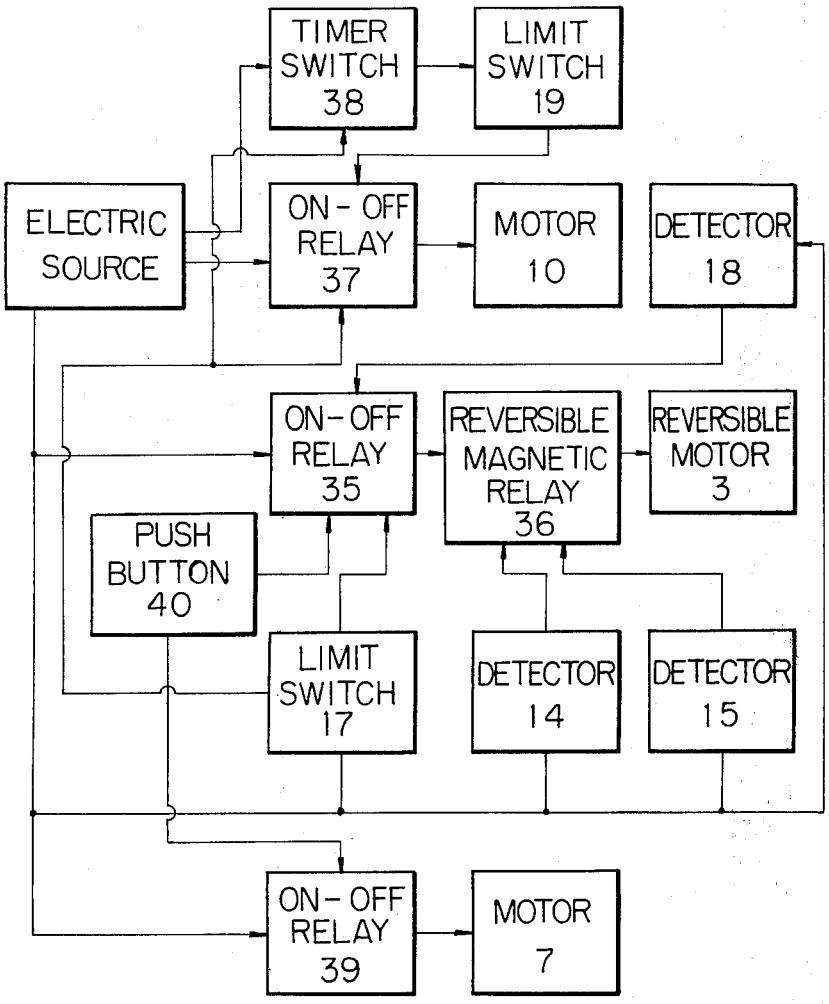
FIG. 8 is a block diagram of a control circuit utilized for the bale plucking machine shown in FIG. 1.

Referring to FIGS. 1, 2 and 8, in the present invention, the detector 15 is positioned at a particular disposition above the horizontal plane XX or the conveyer means 1 and 2. That is, the distance between the ligth beam issued from the light projector 15*a* of the detector 15 and the horizontal plane XX is selected to be *l*, which corresponds to the mass of a fiber bale being processed on which a fresh fiber bale should be supplied. Therefore, when the height of the fiber bale being processed becomes lower than the light beam projected from the light projector 15*a*, the photocell 15*b* does not issue a signal, the fiber bale being processed is displaced to the inclined portion of the endless belt 1*d*. When the fiber bale being processed contacts the stopper 16, the limit switch 17 issues a signal to open the on-off relay 35 so that the motor 3 is stopped. In this condition, the fiber bale being processed is temporarily positioned on the inclinded portion of the endless belt 1*d*. The limit switch 17 also issues a signal to close an on-off relay 37 which connects or disconnects the motor 10 with the electric source so that the on-off relay 37 is closed. Consequently, the motor 10 is driven and a fresh fiber bale stored on the Conveyer means 9 is carried to the conveyer means 1. When the light beam projected from the light projector 18*a* (FIG. 2) is intercepted by the fresh fiber bale F so that the photocell 18*b* does not receive the light from the projector 18*a*, the detector 18 issues a signal to close the on-off relay 25 in the same manner as the detector 15, so that the conveyer means 1 is driven. Accordingly, the fresh fiber bale F and the fiber bale being processed P′ are carried toward the conveyer means 2 in superposed condition. The limit switch 17 also issues a signal when a fiber bale P′ contacts the stopper 17, and this signal is transmitted to a timer switch 38, which connects the limit switch 19 with the electric source, so as to disconnect the limit switch 19 from the electric source for a fixed time which is sufficient to prevent the actuation of the limit switch 19 when a forward tail end portion of the fresh fiber bale F passes over the projected portion 29*a* (see FIG. 6). Therefore, even if the forward tail end portion of the fresh fiber bale F pushes the projected portion 29*a* of the auxiliary feeler 29, the limit switch 19 does not actuate. However, when a tail end portion of the fresh fiber bale F pushes the projected portion 29*a*, the limit switch 19 is actuated so that the on-off relay 37 is opened. Accordingly the motor 10 is stopped. The motor 7 for driving the plucking roller 6 is connected to the electric source by way of an on-off relay 39. The on-off relays 35 and 39 are initially closed by a push button 40 when the plucking operation is commenced.

As mentioned above, the plucking operation is always carried out on a fiber bale being processed which has a mass which is heavier than a predetermined weight so as to maintain a uniform plucking operation.

According to our experience, it is perferable to utilize an auxiliary conveyer belt means 9 provided with a sufficient length for reserving a plurality of fresh fiber bales thereon so as to always reserve a fresh fiber bale F at a forward position adjacent to the roller 9*a*. In this case, a plurality of fresh fiber bales may be supplied on the endless apron 9*c* at one time so that the manual cost for supplying the fresh fiber bales on the endless apron 9*c* can be effectively reduced.

In the above-mentioned embodiment, the endless aprons 1*d*, 2*c* and 9*c* are utilized for the respective conveyer means 1, 2 and 9. Instead of utilizing these endless aprons 1*d*, 2*c* and 9*c*, roller conveyer means comprising a plurality of horizontal rollers arranged in parallel and driven by a conventional power transmission means such as a belt or chain drive mechanism can be utilized.

What is claimed is:

1. In an operation for plucking fiber tufts from successive fiber bales, by a bale plucking machine comprising a pair of conveyers arranged to move a bale back and forth, and a plucking roller disposed between said conveyers, said plucking roller being operative upon said bale during reciprocal displacement of said bale over said plucking roller, a method for supplying a fresh fiber bale to said conveyers, said method comprising the steps of detecting the thickness of the bale being processed, stopping the driving of said conveyers when less than a predetermined thickness of said bale being processed is detected, displacing said bale being processed to a waiting position located outside of said area of said reciprocal displacement on said conveyers, supplying a fresh fiber bale to said bale being processed, while said bale being processed is positioned at said waiting position, driving said stopped conveyers when the forward ends of said fresh bale and said bale being processed overlap each other, and reciprocally displacing said bale being processed and said supplied fresh fiber bale over said plucking roller.

2. In a bale plucking machine comprising a pair of main conveyer means disposed at an identical level with an intervening space therebetween, and a plucking roller disposed in said intervening space, means for driving said main conveyer means to and fro so that a bale is reciprocally displaced between two ends thereof, end detecting means disposed at respective positions adjacent to said ends of said main conveyers so that the arrival of a fiber bale at each of said ends is detected, means for changing the driving direction of said driving means alternately according to signals from said detecting means, a device including an auxiliary conveyer means for supplying a fresh fiber bale onto one of said main conveyer means, one of said main conveyer means being provided with a downwardly inclined end portion extending from said end, thickness detecting means for detecting the thickness of the fiber bale being processed, said thickness detecting means being disposed at a position above the level of the base of said fiber bale at a predetermined intervening distance ($l$) from said base, said auxiliary conveyer means being disposed above said inclined end portion of said main conveyer means in such a condition that the intervening distance from said inclined end portion of said conveyer means is larger than $l$, means for stopping said fiber bale being processed at a waiting position on said inclined end portion of said main conveyer means in response to detection by said thickness detecting means, a limit switch mounted to said stopping means, and operable when said processing fiber bale contacts said stopping means, means for driving said auxiliary conveyer means by a signal issued from said limit switch, and means for actuating said driving means of said main conveyer means in response to the arrival of a forward end of a fresh fiber bale at a forward end of the waiting fiber bale being processed, while located at said waiting position, and means for stopping said auxiliary conveyer means when a said fresh fiber bale is displaced onto said fiber bale positioned on said inclined portion of said conveyer means.

3. A device for supplying a fresh fiber bale onto a conveyer means of a bale plucking machine according to claim 2, further comprising a horizontal roller located above said inclined conveyer portion and turnably disposed at a position between the forward end of said auxiliary conveyer means and a starting portion of said inclined portion of said conveyer means.

4. A device for supplying a fresh fiber bale onto a conveyer means of a bale plucking machine according to claim 2, wherein one of said end detecting means is located higher than said other end detecting means and is connected to serve also the said thickness detecting means.

5. A device for supplying a fresh fiber bale onto a conveyer means of a bale plucking machine according to claim 2, wherein all of said detecting means are provided with an identical structure, and each said detecting means comprises a light projector disposed at an adjacently outside position of the respective conveyer means and a photocell disposed at an oppositely outside position of said conveyer means in a position facing said light projector.

6. A device for supplying a fresh fiber bale onto a conveyer means of a bale plucking machine according to claim 2, wherein said driving means for driving said main conveyer means includes a reversible motor, said means for changing the driving direction of said driving means includes a reversible magnetic relay which is actuated by signals issued from either one of said end detecting means.

7. A device for supplying a fresh fiber bale onto a conveyer means of a bale plucking machine according to claim 2, wherein said means for stopping said processing fiber bale at a waiting position on said inclined end portion of said main conveyer means comprises a stopper adjustably mounted on a frame of said main conveyer means in transverse position over said inclined portion of said conveyer means, and said limit switch is mounted on said stopper, said stopper being provided with an auxiliary feeler which is capable of displacing when said fiber bale being processed contacts therewith, and wherein said limit switch includes a feeler actuated by said auxiliary feeler when said auxiliary feeler is displaced.

8. A device for supplying a fresh fiber bale onto a conveyer means of a bale plucking machine according to claim 2, wherein said, means for stopping said auxiliary conveyer means comprises a transversal bracket disposed at a position between the forward end of said axiliary conveyer means and a starting portion of said inclined portion of said conveyer means, and an auxiliary feeler turnably mounted on said bracket and a limit switch mounted on said bracket in such a condition that said auxiliary feeler actuates said limit switch when a tail end portion of said fresh fiber bale turns said auxiliary feeler.

* * * * *